United States Patent [19]

Yamamoto

[11] Patent Number: 4,502,480

[45] Date of Patent: Mar. 5, 1985

[54] HELMET EQUIPPED WITH DEVICE FOR SUPPLYING ATMOSPHERIC AIR

[75] Inventor: Tamenobu Yamamoto, Higashi-Osaka, Japan

[73] Assignee: Yamamoto Kogaku Co., Ltd., Higashi-Osaka, Japan

[21] Appl. No.: 469,247

[22] Filed: Feb. 24, 1983

[51] Int. Cl.[3] ..... A62B 7/04

[52] U.S. Cl. ..... 128/201.15; 128/201.25; 128/205.12

[58] Field of Search ..... 128/201.15, 201.24, 128/201.25, 201.29, 205.12, 205.29; 2/2.5, 5, 6, 414, 423, 424

[56] References Cited

U.S. PATENT DOCUMENTS

| | | | |
|---|---|---|---|
| 2,365,779 | 12/1944 | Schwab | 128/201.25 |
| 3,223,086 | 12/1965 | Denton | 128/201.24 |
| 3,736,927 | 6/1973 | Misagi | 128/201.25 |
| 4,083,065 | 4/1978 | Warncke . | |
| 4,115,874 | 9/1978 | Hasegawa . | |
| 4,402,316 | 9/1983 | Gadberry | 128/201.15 |

FOREIGN PATENT DOCUMENTS

| | | | |
|---|---|---|---|
| 2498060 | 7/1982 | France | 2/424 |
| 2032284 | 5/1980 | United Kingdom | 128/201.25 |
| 2061696 | 5/1981 | United Kingdom | 2/5 |

*Primary Examiner*—Henry J. Recla

*Attorney, Agent, or Firm*—Armstrong, Nikaido, Marmelstein & Kubovcik

[57] ABSTRACT

A helmet comprising a face shield and a device for supplying atmospheric air to the interior of the helmet. The device has filters for removing dust particles and noxious substances from the atmospheric air to be drawn in and supplied to the inner surface of the face shield.

8 Claims, 4 Drawing Figures

HELMET EQUIPPED WITH DEVICE FOR SUPPLYING ATMOSPHERIC AIR

BACKGROUND OF THE INVENTION

The present invention relates to a helmet equipped with an atmospheric air supplying device, and more particularly to a helmet useful for motorcycle riders.

Helmets heretofore known for motorcycle riders include those of the full-face type having a face shield for entirely covering the face. Although effective for protecting the rider from the wind, such helmets have the problem of permitting the rider to inhale exhaust gases, dust and other pollutants which seriously impair his health during motorcycling for a prolonged period of time.

Furthermore the helmet of the type described involves the likelihood that the face shield will sometimes fog up to result in poor visibility. During the hot summer season, the rider perspires to fog the face shield, while in winter, the face shield is exceedingly cooled during running to permit moisture or water vapor to condense on the shield to cause fogging. Especially when the motorcycle is stopped after running, the breath and hot air are confined in the space between the face shield and the face owing to poor ventilation, invariably fogging up the shield.

SUMMARY OF THE INVENTION

The main object of the present invention is to provide a helmet equipped with a device for supplying atmospheric air, whereby cleaned atmospheric air is fed to the rider for his health during motorcycling. Irrespective of whether the rider is running or at a stop, the space between the face and the face shield of the helmet is forcedly ventilated by the device for preventing the face shield from fogging. For this purpose, the device of the invention has an air feed outlet opened to the inside of the face shield, an air intake opened to the atmosphere and communicating with the air feed outlet, feeding means including an electric motor and a fan for drawing in atmospheric air from the air intake and supplying the air to the air feed outlet, and air filter means for cleaning the air before the air is supplied to the air feed outlet.

Preferably the air filter means comprises a first filter for removing dust particles from air and a second filter for removing from air noxious substances including carbon monoxide, whereby cleaned air is supplied to the interior of the helmet to protect the motorcycle rider from the atmospheric air which is polluted with exhaust gases. The two filters are removably mounted on cylinders individually. The cylinder for the first filter is removably screwed on the cylinder for the second filter concentrically therewith, and the cylinder for the second filter is removably mounted on the air intake portion of the device concentrically therewith. Thus the filters are made easy to replace.

The air feed outlet is provided with a plurality of flow guide plates arranged laterally at a spacing for forcing out air from the outlet uniformly against the inner surface of the face shield. When necessary, the device is provided with a heater for heating the air to be supplied to the air feed outlet, whereby the face shield is prevented from fogging due to the deposition or freezing of condensate while motorcycling in a cold climate.

The atmospheric air supplying device of the present invention can be composed of a feeder, a case and a duct for connecting the feeder to the case in communication therewith. The case is incorporated in a protector portion of the helmet which portion is to be positioned close to the chin of the wearer. The case has the air feed outlet which is opened to the inside of the face shield. Preferably the feeder is fixedly mounted on a suitable portion of the motorcycle. The air intake is formed in the feeder and provided with the air filter means. The feeding means is incorporated in the feeder or the case. The means for supplying power to the electric motor of the feeding means is mounted preferably on one side of the feeder, or the battery of the motorcycle itself serves as the power supply means. This arrangement reduces the weight of the helmet, i.e., the load to be applied to the head of the wearer by the helmet. To assure safety or to permit the rider to get off the motorcycle with ease, it is preferable to make the duct separable from the case. To this end, a connector secured to the duct is rendered insertable into and removable from an opening of the case.

Unlike the foregoing arrangement, the atmospheric air supplying device of the invention can be incorporated in its entirety into the helmet. With this arrangement, the case is incorporated into the protector portion of the helmet and has incorporated therein the feeding means including an electric motor and a fan. The air feed outlet opened to the inside of the face shield is formed at one end of the case, and the air intake is formed at the other end thereof and provided with the air filter means. The power supply means is mounted on a suitable portion of the helmet. With this arrangement, the power supply means is in the form of a unit, and the other components are assembled into another unit. This assures improved productivity.

The other objects and features of the present invention will become apparent from the following description.

DESCRIPTION OF THE PREFERRED EMBODIMENTS

Figure 1:
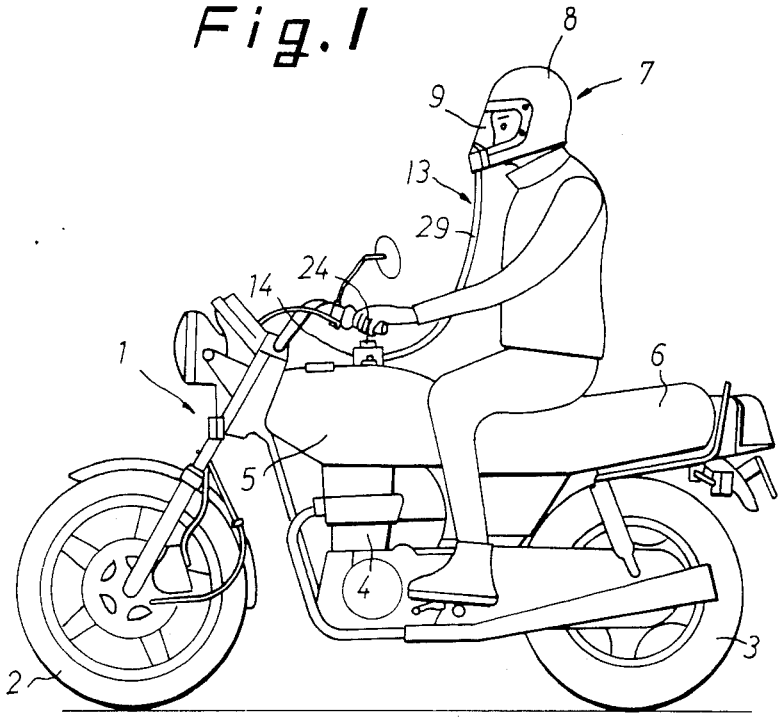
FIG. 1 is a side elevation showing a rider wearing a helmet of the invention and riding a motorcycle.

FIG. 1 shows a rider riding a motorcycle 1 and wearing a helmet 7 according to first or second embodiment of the invention. The motorcycle 1, which is well known, has a front wheel 2, rear wheel 3, engine 4, fuel tank 5, seat 6, etc. The helmet 7 has a rigid shell 8 and a face shield 9. As will be apparent from FIG. 2, the shell 8 is in the form of a cap fitting over the head of the wearer (rider) and formed with an opening 10 for exposing the face of the wearer. Under the opening 10, the shell 8 has a protector portion 8*a* positioned close to the chin of the wearer and integral with the shell 8. Alternatively the protector portion 8*a* is separate from the shell 8 and is removably fixed to the shell 8 although not shown. The face shield 9 is in the form of a transparent or opaque resin plate and openably closes the opening 10 of the shell 8. Thus the helmet is of the full-face type.

Figure 2:
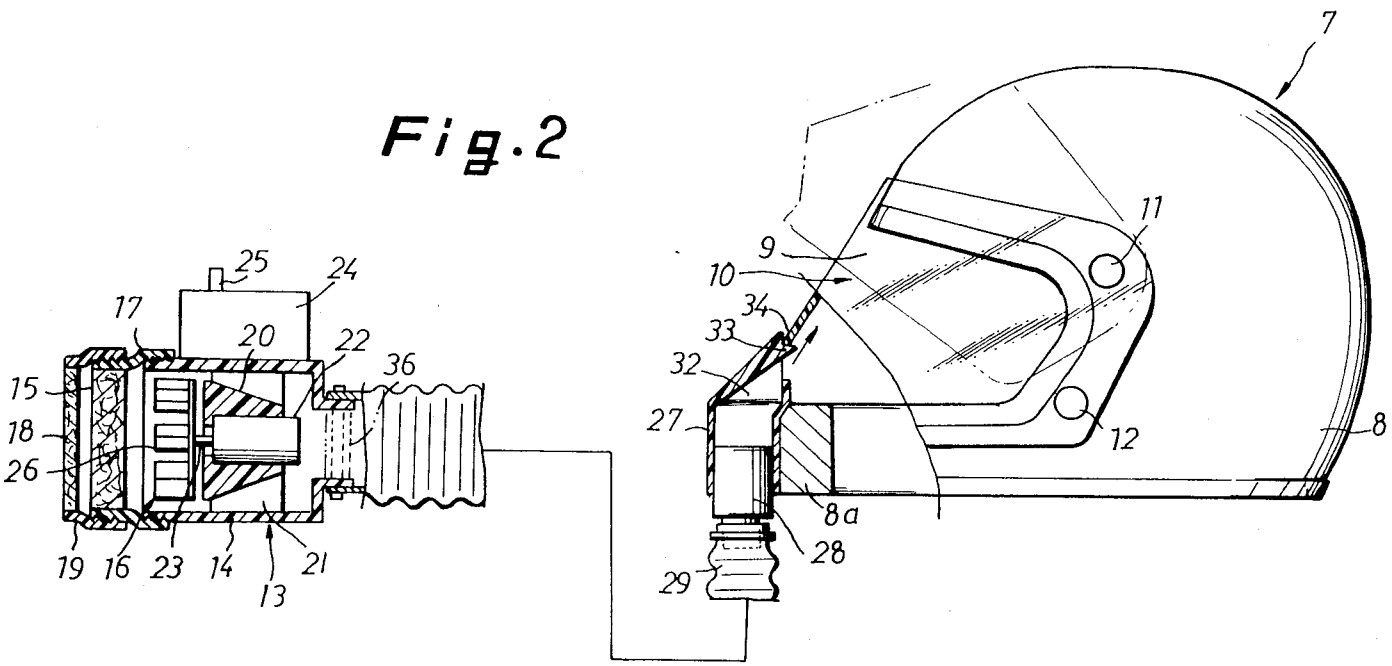
FIG. 2 is a side elevation partly in section and showing a first embodiment of the invention.

The face shield 9 is pivoted at its upper opposite side corners to the shell 8 by pins 11 and is thereby made turnable from a closed position indicated in solid lines in FIG. 2 to an opened position indicated in broken line in FIG. 2. The shield is locked in the closed position by snap means 12. The shield 9 in this position is preferably in intimate contact with the edge portion of the shell 8 defining the opening 10 but can be spaced therefrom by a small clearance. The shield 9 is holdable in its opened position by the frictional resistance between the shield and the shell 8 at the pivoted portions 11.

FIG. 2 shows an atmospheric air supplying device 13 according to first embodiment of the invention. The device 13 comprises a feeder 14 positioned away from the helmet 7, a case 27 incorporated in the helmet 7, and a duct 29 connecting the feeder 14 to the case 27.

The feeder 14 is in the form of a cylinder made of a rigid material, such as synthetic resin, and is removably but fixedly mounted on a suitable portion of the motorcycle 1, for example, on the top of the fuel tank 5. The feeder 14 may be attached to a suitable portion of the body of the wearer. The feeder 14 has an air intake 16 which is provided with an exhaust gas cleaning filter 15 and a dust removing filter 18. The exhaust gas cleaning filter 15 is removably inserted in a cylinder 17, which is fixed to the feeder 14 removably as by a screw. The filter 15 has a known agent for absorbing carbon monoxide or a catalyst (such as platinum) for catalytically treating carbon monoxide. The dust removing filter is removably mounted on a cylinder 19, which is removably secured to the cylinder 17 as by a screw. The filter 18, which has the function of removing dust particles from the air to be drawn in, is made for example of a net of fine mesh size. Within the feeder 14, an electric motor 22 is mounted on a support member 20, which is in the form of a hollow cone having ribs 21 on its outer periphery. The ribs 21 are secured to the inner peripheral surface of the feeder 14. The motor 22 is removably inserted in the center of the support member 20 and has an output shaft 23 projecting toward the air intake 16. Power supply means 24 mounted on the outer periphery of the feeder 14 is coupled to the motor 22 for supplying power thereto. A switch 25 is provided for energizing or deenergizing the motor 22. The power supply means 24 may be separate from the feeder 14 and attached to a suitable portion of the body of the rider. Alternatively the battery of the motorcycle 1 can be utilized. A fan 26 for drawing in atmospheric air is positioned between the support member 20 and the exhaust gas cleaning filter 15 and fixedly mounted on the output shaft 23. The fan 26 is preferably an axial-flow propeller fan, but a sirocco fan, centrifugal fan or the like is usable.

The case 27 incorporated in the helmet 7 is made of a rigid material, such as synthetic resin, and removably attached to the protector portion 8*a* of the helmet 7, for example, with screws. The case 27 has a lower opening, in which a connector 28 is removably installed by snap-in means, screw means or the like. The air duct 29, which is flexible, is fixed at its one end to the connector 28. The other end of the duct 29 is connected to an air discharge outlet of the feeder 14. The case 27 is formed at its upper portion with an air feed outlet 30 which is opened to a space 31 formed between the face shield 9 and the face. The air feed outlet 30 is provided with a plurality of flow guide plates 32 arranged laterally at a spacing within the case 27. The case 27 has a slanting front wall formed with a groove 33 in its upper edge. The face shield 9 is cut out in the form of a recess to provide an edge 34 which is shaped in conformity with the shape of the case 27 and which is fitted in the groove 33. The discharge outlet portion of the feeder 14 is provided with a heater 36 which is connected to the power supply means 24.

The first embodiment operates in the following manner. When a rider wearing the helmet 7 drives the motorcycle 1, the switch 25 for the power supply means 24 is turned on to drive the motor 22. The fan 26 driven draws atmospheric air into the feeder 14 through the two filters 18 and 15. Dust particles are first removed from the air to be drawn in by the dust removing filter 18. Carbon monoxide is then removed from the air by the cleaning filter 15. Thus cleaned air only is drawn into the feeder 14. The air is then passed through the fan and supplied from the feeder 14 to the case 27 in the helmet 7 via the duct 29. The air supply to the case 27 is laterally diffused by the flow guide plates 32 and forced out from the feed outlet uniformly against the inner surface of the face shield 9. Consequently the space 31 between the face shield 9 and the face of the wearer is given a higher pressure than the atmosphere. Even if there is a small clearance between the helmet 7 and the wearer's head or between the face shield 9 and the shell 8, the air within the helmet 7 flows out through the clearance without permitting the atmospheric air to flow directly into the helmet 7 through the clearance, with the result that the interior of the helmet 7 is filled with cleaned air at all times, preventing the rider from inhaling carbon monoxide gas and dust particles contained in exhaust gases. The supply of air to the helmet 7 is diffused by the flow guide plates 32 and uniformly forced against the inner surface of the face shield 9 without stimulating the eyes of the wearer by directly striking them. Further because the interior space 31 of the shield 9 is suitably ventilated with the air supply and maintained approximately at the same temperature and humidity as the atmosphere, the face shield 9 can be prevented from fogging. During motorcycling in a very cold climate, the heater 36 is operated as desired to apply hot air to the inner surface of the face shield 9, which is therefore prevented from fogging due to deposition or freezing of condensate. When the rider gets off the motorcycle, the connector 28 is removed from the case 27, whereby the duct 29 can be separated from the helmet 7 easily. If the motorcycle falls down, the duct 29 is similarly separable from the helmet with ease to ensure safety.

Figure 3:
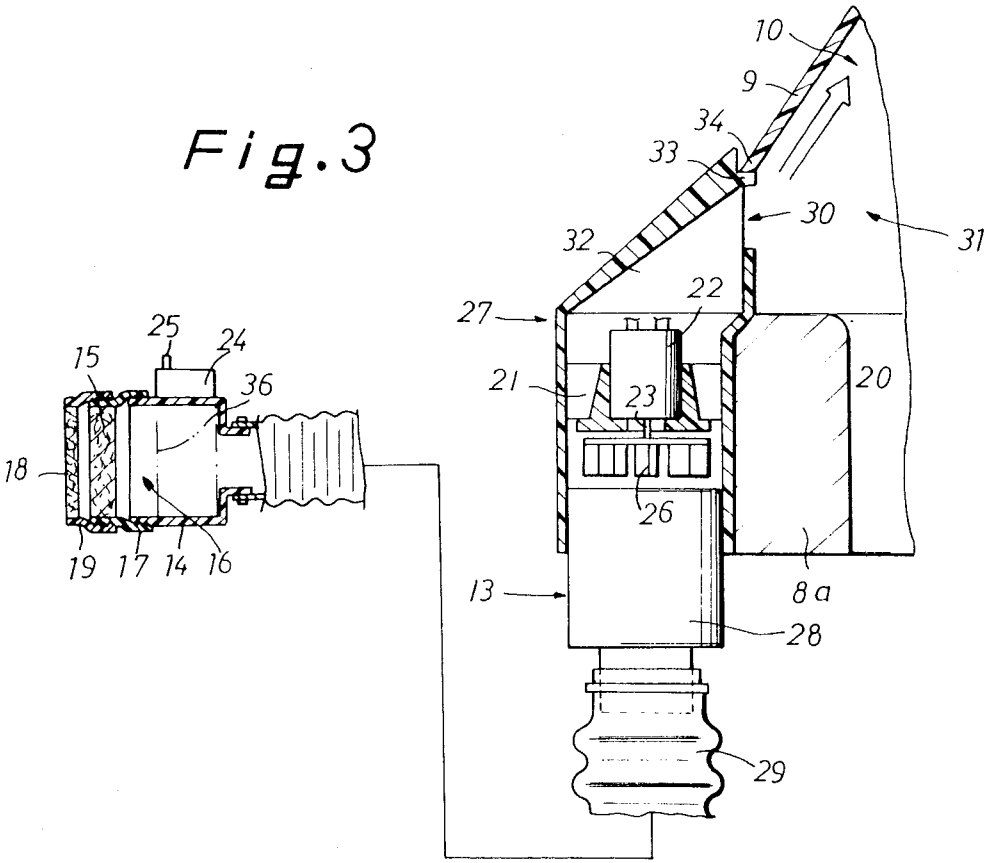
FIG. 3 is a fragmentary view in vertical section showing a second embodiment of the invention.

FIG. 3 shows a second embodiment of the invention. The atmospheric air supplying device of this embodiment indicated at 13 includes an electric motor 22 fixedly mounted on a support member 20 within a case 27 which is incorporated in a helmet 7. Accordingly a feeder 14 has no drive means for supplying air. Power supply means 24 may be provided in the feeder 14 as illustrated or incorporated in a side portion of the shell 8. With the exception of the above feature, the second embodiment basically has the same construction as the first, so that the corresponding parts are referred to by correspondingly the same reference numerals as above for a better understanding.

Figure 4:
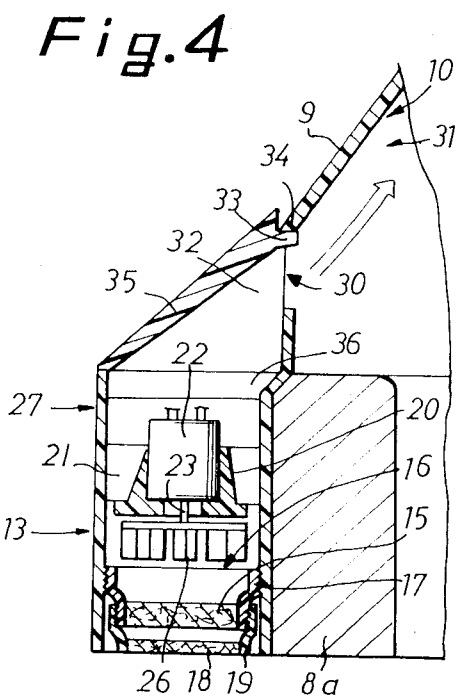
FIG. 4 is a fragmentary view in vertical section showing a third embodiment of the invention.

FIG. 4 shows a third embodiment of the invention. The device is not provided with the above-mentioned feeder and duct. As is the case with the second embodiment, an electric motor 22 having a fan 26 is fixedly mounted on a support member 20 within a case 27 which is incorporated in a helmet 7. The case 27 is formed at its lower portion with an air intake 16, which is provided with filters 15 and 18. A heater 36 is positioned above the motor 22 and accommodated in the case 27. The case 27 is fixedly but removably provided with a slanting front wall 35 having flow guide plates 32 to render the heater 36 removably mountable in the case 27 easily. Although not shown, the power supply means for the motor 22 and the fan 26 is incorporated in a side portion of the shell 8. With the exception of the above feature, the third embodiment basically has the same construction as the first and second embodiments, so that the corresponding parts are referred to by correspondingly the same reference numerals as above for a better understanding.

The present invention is not limited to the foregoing embodiments but can be modified variously within the scope of the invention defined in the appended claims. For example, another filter may be used in place of or in addition to the double filter means included in the foregoing embodiments for removing dust particles and carbon monoxide, in order to remove other noxious substances from atmospheric air.

What is claimed is:

1. A helmet comprising a shell having an opening positionable at the face of a wearer and a protector portion positionable close to the chin of the wearer, a face shield over the opening and a device for supplying atmospheric air to the interior of the helmet, the atmospheric air supplying device having a case incorporated in the protector portion of the helmet, the case having an air feed outlet, a feeder positioned away from the case, the feeder including an air intake, a flexible duct connected between the case and feeder for coupling the case to the feeder feeding means in said feeder including an electric motor and a fan for drawing atmospheric air from the air intake of the feeder and supplying the air to the air feed outlet in the case via said flexible duct, the air feed outlet opening to the inside of the face shield, and air filter means provided at the air intake of the feeder for cleaning the atmospheric air drawn into the air intake.

2. A helmet as defined in claim 1 wherein the air filter means comprises a first filter for removing dust particles from the air and a second filter for removing air noxious substances including carbon monoxide from the air.

3. A helmet as defined in claim 2 wherein the air feed outlet includes a plurality of flow guide plates spaced laterally for forcing air from the outlet uniformly against the inner surface of the face shield.

4. A helmet as defined in claim 3 further including heater means for heating the air supplied to the air feed outlet.

5. A helmet as defined in claim 2 further including first and second cylinders and wherein each of the first and second filters is mounted respectively, in said cylinders, the cylinder for the first filter being screwed onto the cylinder for the second filter concentrically therewith, the cylinder for the second filter being screwed onto the feeder concentrically whereby the filters are in the air intake of the feeder.

6. A helmet as defined in claim 1 further including a connector secured to one end of the flexible duct and removably inserted in the case in the helmet protector portion, and the feeder is secured to the other end of the duct and adapted to be fixed to a portion of a motorcycle vehicle.

7. A helmet comprising a shell having an opening positionable at the face of a wearer and a protector portion positionable close to the chin of the wearer, a face shield over the opening and a device for supplying atmospheric air to the interior of the helmet, the atmospheric air supplying device having a case positioned in the protector portion of the helmet and an air feed outlet opening to the inside of the face shield and an air intake opening to the atmosphere, feeding means in the case including an electric motor and a fan for drawing in atmospheric air from the air intake and supplying the air to the air feed outlet, and air filter means provided at the air intake of the case for cleaning the atmospheric air drawn in the air intake, the air filter means comprising first and second cylinders, a first filter mounted on the first cylinder for removing dust particles from the air and a second filter mounted on a second cylinder for removing noxious substances including carbon monoxide from the air, the first cylinder for the first filter being screwed onto the second cylinder for the second filter concentrically therewith, the second cylinder for the second filter being screwed onto the air intake portion of the case concentrically therewith whereby the air intake of the case is covered by the filters.

8. A helmet as defined in claim 7 wherein the air feed outlet is provided with a plurality of flow guide plates spaced laterally for forcing air from the outlet uniformly against the inner surface of the face shield.

* * * * *